US007431068B1

(12) United States Patent
Jellá

(10) Patent No.: US 7,431,068 B1
(45) Date of Patent: Oct. 7, 2008

(54) TRIM BOARD SYSTEM WITH CLIP FOR ATTACHMENT TO A GARAGE DOOR

(75) Inventor: John F. Jellá, Tempe, AZ (US)

(73) Assignee: First United Door Technologies, Tempe, AZ (US)

( * ) Notice: Subject to any disclaimer, the term of this patent is extended or adjusted under 35 U.S.C. 154(b) by 0 days.

(21) Appl. No.: 11/402,550

(22) Filed: Apr. 12, 2006

Related U.S. Application Data

(60) Division of application No. 10/689,890, filed on Oct. 20, 2003, now abandoned, which is a continuation-in-part of application No. 09/792,543, filed on Feb. 22, 2001, now abandoned.

(51) Int. Cl.
*E06B 3/06* (2006.01)

(52) U.S. Cl. ..... 160/236

(58) Field of Classification Search ..... 160/201, 160/236; 52/716.6, 716.8, 717.01, 718.01, 52/718.04, 718.06, 718.03, 717.06, 716.5, 52/718.02, 716.1; 411/510; 248/231.9
See application file for complete search history.

(56) References Cited

U.S. PATENT DOCUMENTS 2,297,887 A 10/1942 Hall et al.
3,252,677 A * 5/1966 Raymond ..... 248/68.1
4,284,119 A 8/1981 Martin et al.
4,709,525 A * 12/1987 Adell ..... 52/716.6
5,016,700 A 5/1991 Wegner et al.
5,353,571 A * 10/1994 Berdan et al. ..... 52/716.5
5,509,457 A 4/1996 Jella
5,598,668 A * 2/1997 Isom ..... 52/86
5,737,802 A 4/1998 Jella
6,112,481 A * 9/2000 Schiedegger et al. ..... 52/211
6,148,896 A 11/2000 Pinto et al.
6,295,779 B1 * 10/2001 Canfield ..... 52/656.4

* cited by examiner

*Primary Examiner*—Blair M. Johnson

(57) ABSTRACT

A carriage house replica garage door (20) is formed from first, second, and third door sections (22, 24, 26). Each of the door sections (22, 24, 26) includes a sheet metal layer (30). An insulating foam board (50) has a first side (52) and a second side (54), the first side (52) being coupled to an inner surface (48) of the sheet metal layer (30). A trim board system (150) include clips (158) that couple a channel member (152) of the trim board system (150) to an outer surface (46) of the sheet metal layer (30).

9 Claims, 6 Drawing Sheets

TRIM BOARD SYSTEM WITH CLIP FOR ATTACHMENT TO A GARAGE DOOR

RELATED INVENTION

This application is a divisional application of U.S. patent application Ser. No. 10/689,890 filed Oct. 20, 2003 now abandoned which and which is a continuation-in-part of "DOOR SECTION FOR CARRIAGE HOUSE REPLICA GARAGE DOOR," U.S. patent application Ser. No. 09/792,543, filed 22 Feb. 2001 now abandoned, which is incorporated by reference herein.

TECHNICAL FIELD OF THE INVENTION

The present invention relates to the field of garage doors. More specifically, the present invention relates to garage doors that replicate wood sectional carriage house garage doors.

BACKGROUND OF THE INVENTION

A typical overhead garage door is constructed from a plurality of door sections, which are hinged together and supported from a track system with rollers attached to opposite ends of the door sections. The rollers generally allow the door to be moved from a vertically oriented closed position to a substantially horizontal open position. Electrically powered garage door openers are often used with the overhead garage door so that a driver may conveniently open and close the door from within a vehicle.

With regard to residential applications, an overhead garage door is generally either eight or sixteen feet wide. Typically, such a door includes four horizontally oriented door sections, each of which is about eight or sixteen feet wide and twenty-one inches high. For example, a single car residential garage may have an eight foot wide by seven foot high door. Likewise, a two car residential garage may have a single sixteen foot wide door by seven foot high door or two eight foot wide by seven foot high doors.

Some of the first doors made for garages were one piece barn doors that operated as large swinging or sliding doors. The nostalgic design of these doors is replicated in wood sectional carriage house garage doors. Indeed, wood sectional carriage house garage doors are particularly desirable for use with older homes to maintain the historic design of the home while gaining the convenience of the conventional overhead garage door. Carriage house garage doors are also desirable with newer homes for enhancing the overall appearance of the garage and consequently the house.

A sectional carriage house door functions like a typical overhead garage door in that it moves on a track and roller system to open and close the door. However, the appearance of the sectional carriage house door simulates the historic swing type doors used in early automobile shelters. The historic appearance of the sectional carriage house door is created by the application of various types of wood siding, wood trim boards, and/or wood raised panels applied over the exterior side of wood flush door sections, and wood or steel open frame door sections.

Unfortunately, a wood carriage house garage door is very costly relative to a conventional steel overhead garage door. This cost is due in part to labor costs incurred to perform the largely manual process of constructing the wood carriage house door. Furthermore, the material cost for the wood siding, wood trim boards, and/or wood raised panels is undesirably high. Thus, a homeowner may pay five to six times more for a wood carriage house door than for a conventional steel overhead door.

In addition to the costly initial investment, wood carriage house doors are costly to maintain. In particular, the wood is adversely affected by the elements. That is sun, rain, snow, varying temperatures, and so forth will degrade the finish of the wood and eventually cause the wood to warp, split, or rot. Consequently, the wood carriage house garage door should be re-sealed or re-painted every couple of years to maintain the aesthetic appearance and integrity of the wood carriage house garage door. This labor intensive and costly maintenance is highly undesirable to the typical homeowner.

In addition, insects, such as termites and carpenter ants, frequently attack the wood causing significant damage to the wood. Accordingly, the use of a wood carriage house garage door necessitates frequent inspections and treatment for insect damage. Again, this is a highly undesirable situation to the homeowner in terms of labor and cost.

Another problem with a wood carriage house garage door results from the weight of the wood siding, wood trim board, and/or wood raised panels, which typically adds one hundred to two hundred pounds to the overall weight of the sectional carriage house door. In particular, the wood or steel open frame door sections often lack the structural integrity or the strength to adequately support the added weight of the wood siding. Thus, the wood carriage house door has a limited life.

In addition, the wood carriage house door necessitates the use of reinforced hardware to support the weight of the wood. This leads to higher up front costs incurred by the homeowner for the appropriate hardware. If hardware is used that is insufficient for supporting the door, the door may repeatedly fall out of the door tracks, or the hardware components, such as the rollers, connection points, springs, or the tracks could fail causing property damage and/or injury.

In addition to the excessive cost and mechanical problems associated with a wood sectional carriage house door, the sectional carriage house door suffers from problems associated with aesthetic appearance. In particular, the use of four twenty-one inch horizontally oriented door sections to form the carriage house door results in three horizontal lines created at the section joints. These horizontal lines at the section joints detract from the appearance of the door, which is contrary to the objectives of maintaining the historic design and enhancing the overall appearance of the garage.

Thus, what is needed is an overhead garage door that is affordable, durable, low maintenance, impervious to weather and insects, and replicates the appearance of the historic swing type doors used in early automobile shelters.

SUMMARY OF THE INVENTION

Accordingly, it is an advantage of the present invention that a door section for a carriage house replica garage door is provided.

It is another advantage of the present invention that a door section is provided to form an aesthetically pleasing and cost effective replica of a wood sectional carriage house garage door.

It is another advantage of the present invention that a door section is provided to form a carriage house replica garage door that is relatively lightweight and structurally sound.

Yet another advantage of the present invention is that a door section is provided to form a carriage house replica garage door that is durable and requires little maintenance.

The above and other advantages of the present invention are carried out in one form by a door section for a carriage house replica garage door. The door section includes a sheet metal layer having an outer surface and an inner surface and an insulating foam board having first and second sides. The first side is coupled to the inner surface of the sheet metal layer and the second side has a steel laminate backing. A cellular foam trim board is coupled to the outer surface of the sheet metal layer by bonding and stapling the cellular foam trim board to the outer surface.

The above and other advantages of the present invention are carried out in another form by a clip for attaching a trim board to a door section of a door, the trim board having substantially parallel legs formed along longitudinal edges of a face of said trim board. The clip includes a body having a surface region and side walls along edges of the surface region. A catch is formed on one of the side walls, the catch being configured to interlock with one of the substantially parallel legs of said trim board. A post extends from the surface region, the post being configured to fit within a bore in the door section to retain the trim board onto the door section.

The above and other advantages of the present invention are carried out in yet another form by a trim board system for a door section of a garage door. The trim board system includes a channel member having substantially parallel legs formed along longitudinal edges of a face of the channel member, and an insulating foam board seated in an interior cavity of the channel member. The trim board system further includes a clip for attaching the channel member to the door section. The clip includes a body positioned in the interior cavity of the channel member, the body having a surface region and side walls along edges of the surface region. A catch is formed on one of the side walls and is interlocked with one of the substantially parallel legs of the channel section. A post extends from the surface region. The post is configured to fit within a bore in the door section to retain the trim board onto the door section.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
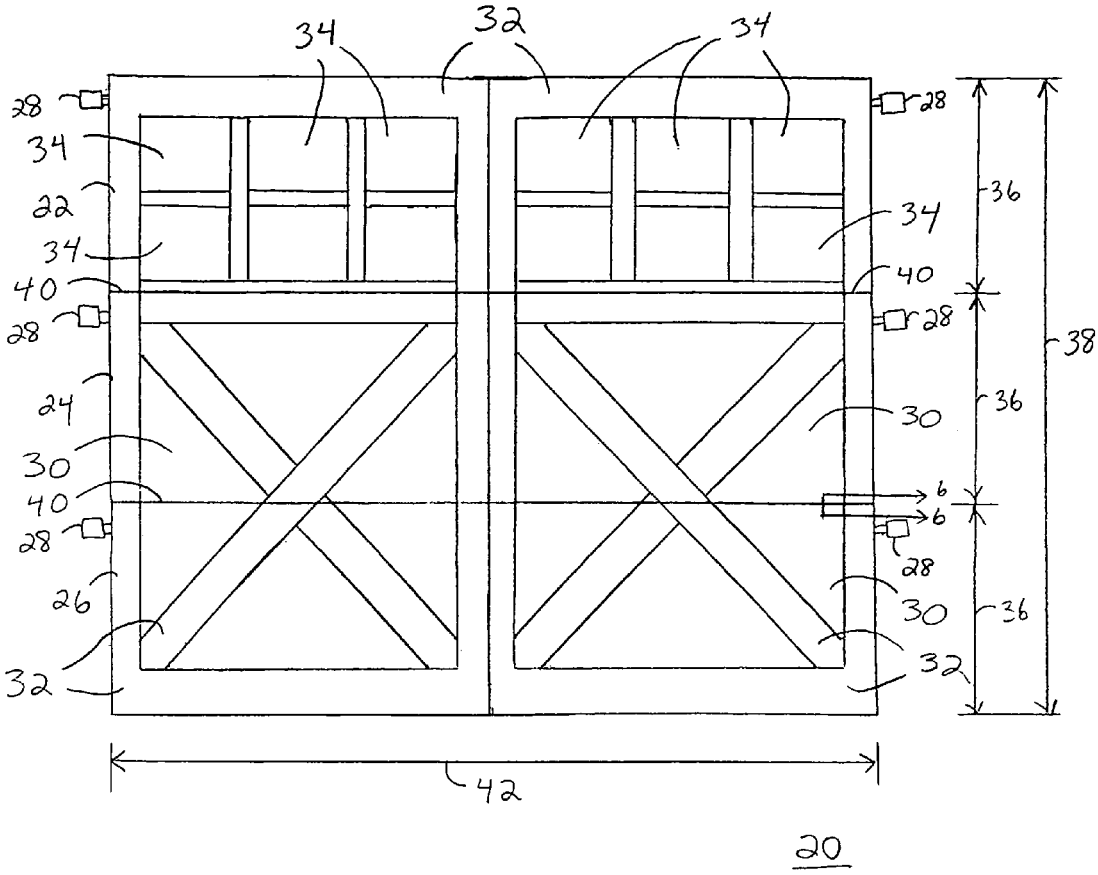
FIG. 1 shows a front view of a carriage house replica garage door in accordance with a preferred embodiment of the present invention.

FIG. 1 shows a front view of a carriage house replica garage door 20 in accordance with a preferred embodiment of the present invention. Carriage house replica garage door 20 replicates in appearance a conventional wood sectional carriage house garage door, hence the use of the term "replica" in carriage house replica garage door 20. Carriage house replica garage door 20 is an overhead sectional garage door having first, second, and third door sections 22, 24, and 26, respectively, that are hinged together.

Guide members 28, attached to opposite ends of each of first, second, and third door sections 22, 24, and 26, allow door 20 to be moved from a vertically oriented closed position to a substantially horizontal open position along a track system (not shown) coupled to a garage (not shown). One exemplary track system including guide members 28 is described in "Door Track", by John F. Jellá, U.S. Pat. No. 5,737,802, issued 14 Apr. 1998, and incorporated by reference herein.

Carriage house replica garage door 20 simulates the appearance of historic swing type doors used in early automobile shelters. However, carriage house replica garage door 20 utilizes materials that are lightweight, resistant to the effects of weather and insects, and low maintenance. For example, carriage house replica garage door 20 includes a sheet metal layer 30 with cellular foam trim boards 32 attached to and arranged in a pattern over sheet metal layer 30. First door section 22 of door 20 also includes windows 34 to further enhance the aesthetic appearance of door 20.

The pattern of cellular foam trim boards 32 over sheet metal layer 30, known as a cross-buck pattern, and the inclusion of windows 34 in carriage house replica garage door 20 represents one configuration of carriage house replica garage door 20. However, it should be apparent to those skilled in the art, that cellular foam trim boards 32 and/or windows 34 may be arranged differently then what is shown in FIG. 1 to obtain a desired style for carriage house replica garage door 20. For example, cellular foam trim boards 32 may be arranged in a half-buck pattern, perimeter pattern, vertical pattern, horizontal pattern, and so forth, while windows 34 may be smaller, larger, include curve tops, and so forth.

In a preferred embodiment, carriage house replica garage door 20 is manufactured from three door sections, i.e., first, second, and third door sections 22, 24, and 26, each having a height 36 of substantially twenty-eight inches. Thus, first, second, and third door sections 22, 24, and 26 function cooperatively to yield an overall height 38 of substantially eight-four inches, or seven feet.

A total of three door sections advantageously decreases a number section joints from three, created by the four sections of conventional overhead doors, to only two section joints 40 created by the three wood overlay sections 22, 24, and 26 of garage door 20. The two section joints 40 of garage door 20 are less conspicuous than the three section joints of a wood carriage house garage door or conventional overhead garage door thereby effectively enhancing the appearance of carriage house replica garage door over conventional sectional garage doors.

In the illustrative embodiment of FIG. 1, each of first, second, and third door sections 22, 24, and 26, respectively, has a width 42 of approximately ninety-six inches, or eight feet. Thus, garage door 20 is sized to fit a conventional single-car residential garage door opening of eight feet wide by seven feet high. Alternatively, garage door 20 may be adapted to fit a two car residential garage having a single sixteen foot wide by seven foot high opening, or another conventional or custom dimensioned garage door opening.

Figure 2:
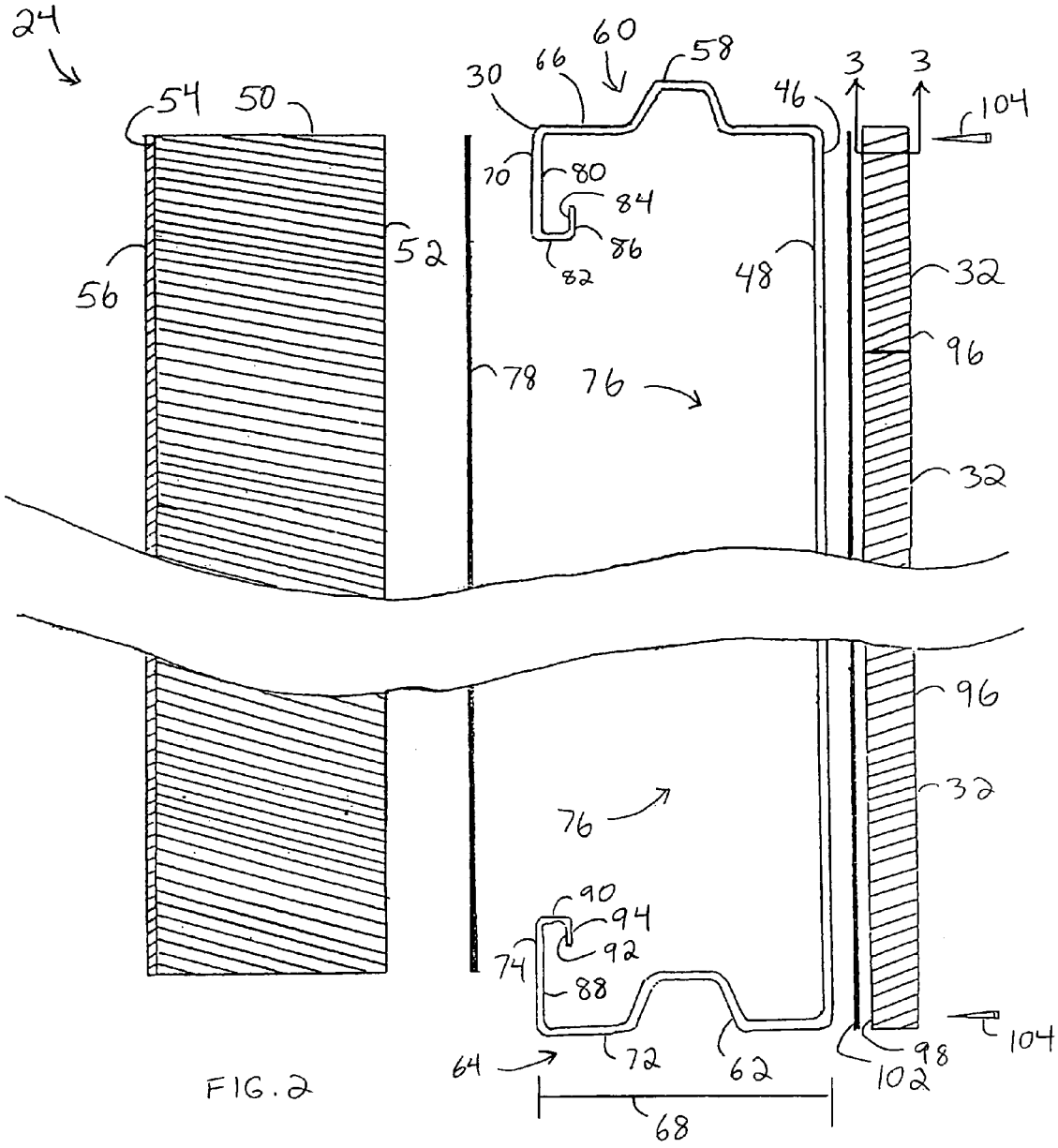
FIG. 2 shows a partial, exploded side view of a door section of the carriage house replica garage door of FIG. 1.

FIG. 2 shows a partial, exploded side view of second door section 24 of carriage house replica garage door 20 (FIG. 1). The structure of second door section 24 is described for clarity of illustration. However, it should be understood that first and third door sections 22 and 26, respectively, are fabricated in a similar manner. The differences between first, second, and third door sections 22, 24, and 26 are the absence or presence of windows 34 (FIG. 1) and/or the pattern of cellular foam trim boards 32. Consequently, the following description of the structure of second door section 24 applies to first and third door sections 22 and 26 as well.

Second door section 24 includes sheet metal layer 30 having an outer surface 46 and an inner surface 48. Sheet metal layer 30 is rotary embossed with a wood grain pattern to replicate an appearance of wood on outer surface 46. An insulating foam board 50 has a first side 52 coupled to inner surface 48 of sheet metal layer 30 and a second side 54 having a steel laminate backing 56. Cellular foam trim boards 32 are coupled to outer surface 46 of sheet metal layer 30. In a preferred embodiment, sheet metal layer 30 is formed from twenty-four gauge steel. Although twenty-four gauge steel is preferred, it should be apparent to those skilled in the art that other widths of steel may be utilized. Alternatively, other metals, such as aluminum, formed into sheets may be utilized.

Sheet metal layer 30 includes a tongue portion 58 along a first longitudinal edge 60 and a groove portion 62 located along a second longitudinal edge 64 of sheet metal layer 30. Following, rotary embossment of sheet metal layer 30 with a wood grain pattern, tongue and groove portions 58 and 62, respectively, are fabricated on sheet metal layer 30 by roll forming. Roll forming is a progressive process in which sheet metal layer 30 is shaped by a series of rolls, each roll slightly changing the shape of the sheet metal. When the sheet metal reaches the end of the line, the desired shape is achieved. Roll forming produces high quality products quickly and inexpensively compared to traditional press operations and is desirable for producing long shapes.

The roll forming of sheet metal layer 30 produces tongue portion 58 having a tongue surface 66 spanning a width 68 of sheet metal layer 30 and a first rear support section 70 contiguous with tongue surface 66. Likewise, the roll forming of sheet metal layer 30 produces groove portion 62 having a groove surface 72 that spans width 68 of sheet metal layer 30 and a second rear support section 74 contiguous with groove surface 72. As such, a cavity 76 is formed in second door section 24.

Insulating foam board 50 is positioned in cavity 76 and first side 52 is bonded to inner surface 48 of sheet metal layer 30 using an adhesive 78. In an exemplary embodiment, adhesive 78 is a hot melt polyurethane reactive (PUR) adhesive. Hot melt PUR adhesive is preferred because it may be applied to a substrate as a dot or as a thin glue line, rather than using a slot die or roll coater. In addition, hot melt PUR adhesive sets in seconds and is structurally rigid in minutes following a final set. Although hot melt PUR adhesive is preferred, it should be apparent to those skilled in the art, that other adhesives may be used in place of hot melt PUR adhesive that have these similar properties.

Insulating foam board 50 is formed from polystyrene foam board insulation. A density of polystyrene insulating foam board 50 is approximately two pounds per cubic foot. Accordingly, polystyrene insulating foam board 50 is known as two-pound-density expanded polystyrene (EPS) foam insulation. Insulating foam board 50 of two-pound-density EPS is desirable due to the thermal performance and structural rigidity of two-pound-density EPS. Although two-pound-density EPS is preferred, it should be apparent to those skilled in the art that other insulating materials may be used. For example, other densities of EPS, polyurethane, and polyisocyanurate are available as rigid foam boards having effective thermal performance.

In a preferred embodiment, steel laminate backing 56 is twenty-six gauge steel laminated, or bonded, to second side 54 of insulating foam board 50. Insulating foam board 50 having twenty-six gauge steel laminate backing 56 is desirable for producing second door section 24 having effective thermal performance and structural rigidity. Although twenty-six gauge steel is preferred for steel laminate backing 56, it should be apparent to those skilled in the art that other widths of steel may be utilized. Alternatively, other metals, such as aluminum, formed into sheets may be utilized.

First and second rear support sections 70 and 74, respectively, are configured to abut steel laminate backing 56 when insulating foam board 50 is installed into cavity 76. In particular, first rear support section 70 includes a first segment 80 oriented substantially perpendicular to and contiguous with tongue surface 66. First segment 80 extends toward second longitudinal edge 64. A second segment 82, contiguous with first segment 80, is formed through the roll forming process and extends toward inner surface 48 of sheet metal layer 30. A third segment 84, contiguous with second segment 82, is formed through the roll forming process and extends toward first longitudinal edge 60. Third segment 84 has a first planar side 86 that abuts steel laminate backing 56 of insulating foam board 50.

Second rear support section 74 is similar to first rear support section 70. In particular, second rear support section 74 includes a first segment 88 oriented substantially perpendicular to and contiguous with groove surface 72. First segment 88 extends toward first longitudinal edge 60. A second segment 90, contiguous with first segment 88 extends toward inner surface 48 of sheet metal layer 30, and a third segment 92, contiguous with second segment 90 extends toward second longitudinal edge 64. Third segment 92 has a second planar side 94 that abuts steel laminate backing 56 of insulating foam board 50. First and second rear support sections 70 and 74, respectively, function to further retain insulating foam core 50 and to provide rigidity and strength to second door section 24.

In a preferred embodiment cellular foam trim boards 32 are formed from cellular polyvinylchloride (PVC) and include a wood grain finish side 96 for replicating an appearance of wood. Cellular PVC (also called PVC foam or expanded PVC) is a form of polyvinylchloride that has been extruded with a foaming agent. Cellular PVC trim boards 32 are resistant to degradation from the weather, durable, and cost effective. Although cellular PVC trim boards 32 are white, they may be readily painted by first wiping boards 32 with alcohol. Generally, cellular PVC trim boards 32 machine similarly to wood, and can be mitered.

Figure 3:
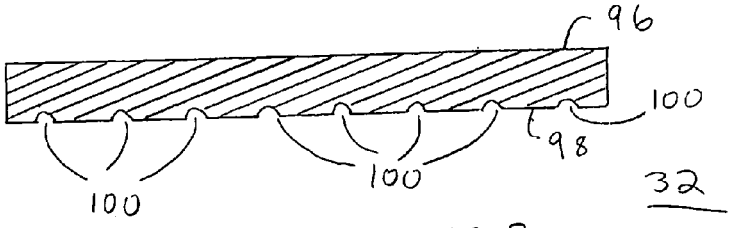
FIG. 3 shows a sectional view of a cellular foam trim board along line 3-3 in FIG. 2.

Referring to FIG. 3 in connection with FIG. 2, FIG. 3 shows a sectional view of cellular foam trim board 32 along line 3-3 in FIG. 2. Cellular PVC trim board 32 has a bonding side 98 configured to be coupled to outer surface 48 of sheet metal layer 30. Bonding side 98 includes spaced-apart channels 100 arranged lengthwise along cellular foam trim board 32. Channels 100 are formed in cellular PVC trim board 32 during the extruding process and serve as glue joints on bonding side 98.

Cellular PVC trim boards 32 are readily bonded to outer surface 46 of sheet metal layer 30 using an adhesive 102. Adhesive 102 may be conventional PVC cement. Alternatively, cellular PVC trim boards 32 may be bonded to outer surface 46 using SB-190 Everseal, manufactured by Surebond, Inc., Schaumberg, Ill. SB-190 Everseal provides effective tensile and impact strength, and securely adheres to most rigid materials.

Cellular PVC trim boards 32 are further secured to sheet metal layer 30 by stapling boards 32 to outer surface 46 using brad nails 104. Brad nails 104 advantageously curl up under sheet metal layer 30 after they have penetrated layer 30 to provide additional adherence of trim boards 32 to sheet metal layer 30 and to provide additional resistance to shear stress.

Although, cellular PVC is preferred for cellular foam trim boards 32, it should be apparent to those skilled in the art that other engineered materials may be used. Other exemplary engineered materials include polystyrene trim, polyurethane trim, polymer composite resin, and polyethylene lumber.

Figure 4:
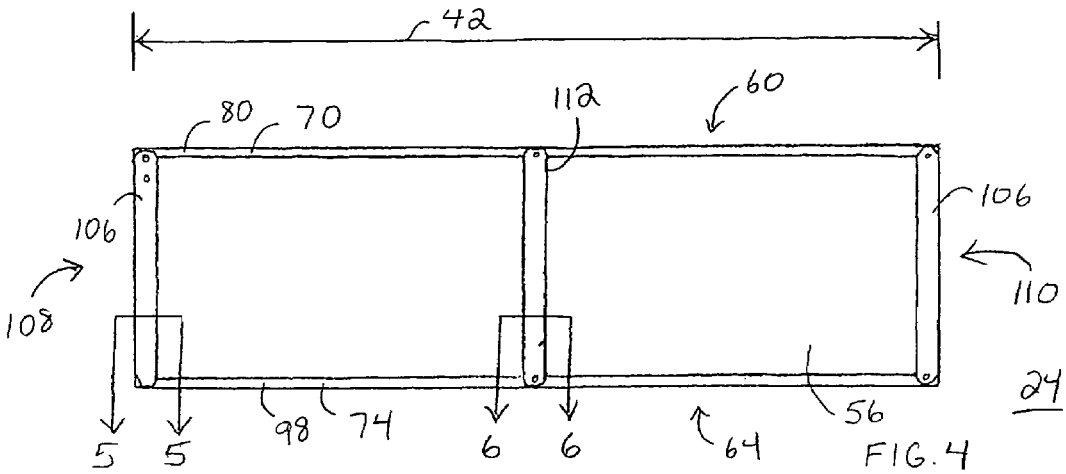
FIG. 4 shows a rear view of a door section of the carriage house replica garage door.

FIG. 4 shows a rear view of second door section 24 of the carriage house replica garage door 20 (FIG. 1). As discussed in connection with FIG. 2, the structure of second door section 24 is described for clarity of illustration. However, the following description of second door section 24 applies to first and third door sections 22 and 26 as well.

Second door section 24 further includes end support members 106 coupled to first and second lateral edges 108 and 110, respectively, of second door section 24. In particular, end support members 106 are stapled to first segment 80 of first rear support section 70 along first and second lateral edges 108 and 110. Likewise, end support members 106 are stapled to first segment 88 of second rear support section 74 along first and second lateral edges 108 and 110. End support members 106 provide structural rigidity along first and lateral edges 108 and 110, and provide a mounting surface for guide members 28 (FIG. 1).

Second door section 24 also includes a center support member 112 coupled to first and second longitudinal edges 60 and 64, respectively, of sheet metal layer 30. In particular, center support member 112 is stapled to each of first segment 80 of first rear support section 70 and first segment 88 of second rear support section 74. Center support members 112 provide structural rigidity along width 42. In particular, center support member 112 functions to prevent second door section 24 from bowing along width 42 between first and second lateral edges 108 and 110, respectively.

In a preferred embodiment, when width 42 of door 20 (FIG. 1) is eight feet, second door section 24 includes one center support member 112 located approximately central to width 42. When width 42 of door 20 is ten to twelve feet, second door section 24 may include two spaced-apart center support members 112. When width 42 is greater than twelve feet, for example, sixteen or eighteen feet, second door section 24 may include three spaced-apart center support members 112.

Figure 5:
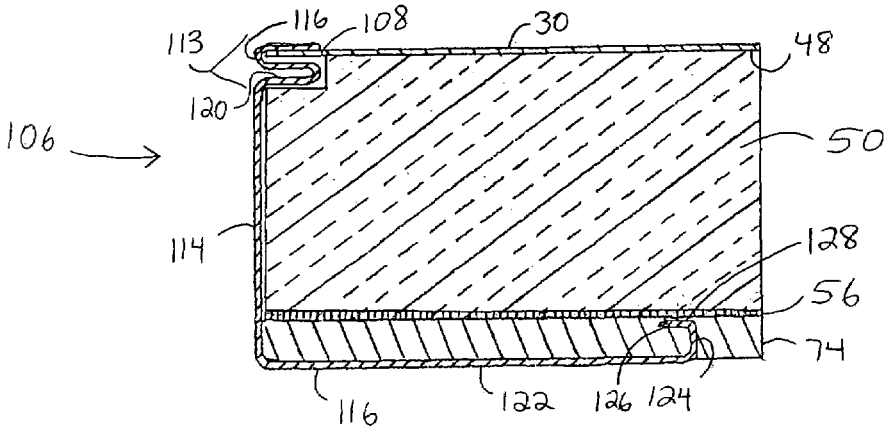
FIG. 5 shows a sectional view of an end support member along line 5-5 in FIG. 4.

FIG. 5 shows a sectional view of one of end support members 106 along line 5-5 in FIG. 4. Each of end support members 106 includes a fanfold section 113, a span section 114 contiguous with fanfold section 113, and a rear support section 116 contiguous with span section 114. End support members 106 are shaped by roll forming twenty-four to twenty-six gauge steel.

As shown in FIG. 5, fanfold section 113 has a first fold 118 configured to mesh with first lateral edge 108 of sheet metal layer 30. A second fold 120 lies against inner surface 48 of sheet metal layer 30 to provide strength. Span section 114 extends away from inner surface 48 of sheet metal layer 30 to conceal insulating foam board 50. As shown, insulating foam board 50 is notched to accommodate second fold 120.

Rear support section 116 includes a first segment 122 oriented substantially perpendicular to span section 114 and extending toward second lateral edge 110. A second segment 124, contiguous with first segment 122, is bent through the roll forming process and extends toward inner surface 48 of sheet metal layer 30. A third segment 126, contiguous with second segment 124, is bent through the roll forming process and extends toward first lateral edge 108. Third segment 126 has a planar side 128 that abuts steel laminate backing 56 of insulating foam board 50.

Figure 6:
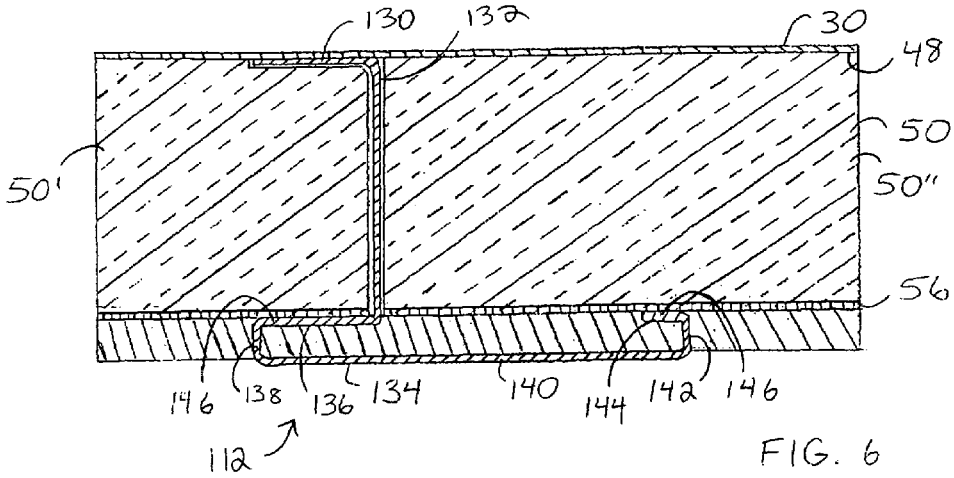
FIG. 6 shows a sectional view of a center support member along line 6-6 in FIG. 4.

FIG. 6 shows a sectional view of center support member 112 along line 6-6 in FIG. 4. Center support member 112 includes an inner support section 130, a span section 132 contiguous with inner support section 130, and a rear support section 134 contiguous with span section 132. Center support member 112 is shaped by roll forming twenty-four to twenty-six gauge steel.

As shown in FIG. 6, inner support section 130 is interposed between inner surface 48 of sheet metal layer 30 and first side 52 of insulated foam board 50. Span section 132 extends away from inner surface 48 of sheet metal layer 30. Insulated foam board 50 is split into two portions, referred to herein as first insulated foam board 50' and second insulated foam board 50", so that span section 132 may be located between first and second insulated foam boards 50' and 50", respectively.

Rear support section 134 includes a first segment 136 oriented substantially perpendicular to and contiguous with span section 132. First segment 136 extends toward first lateral edge 108 (FIG. 4) of sheet metal layer 30. A second segment 138, contiguous with first segment 136, is bent through the roll forming process to extend away from inner surface 48 of sheet metal layer 30. A third segment 140, contiguous with second segment 138, is bent through the roll forming process to extend toward second lateral edge 110 of sheet metal layer 30. A fourth segment 142, contiguous with third segment 140, is bent through the roll forming process to extend toward inner surface 48 of sheet metal layer 30. A fifth segment 144, contiguous with fourth segment 142, is bent through the roll forming process to extend back toward first lateral edge 108 of sheet metal layer 30. Each of first and fifth segments 136 and 144, respectively, have a planar side 146 that abuts steel laminate backing 56 of insulating foam board 50.

In addition, to preventing bowing of second door section 24 along width 42, center support member 112 also provides structural rigidity throughout a thickness of door section 24. This structural rigidity is provided by the cooperative relationship between inner support section 130, span section 132, and rear support section 134 and by roll forming center support member 112 from one piece of steel.

Figure 7:
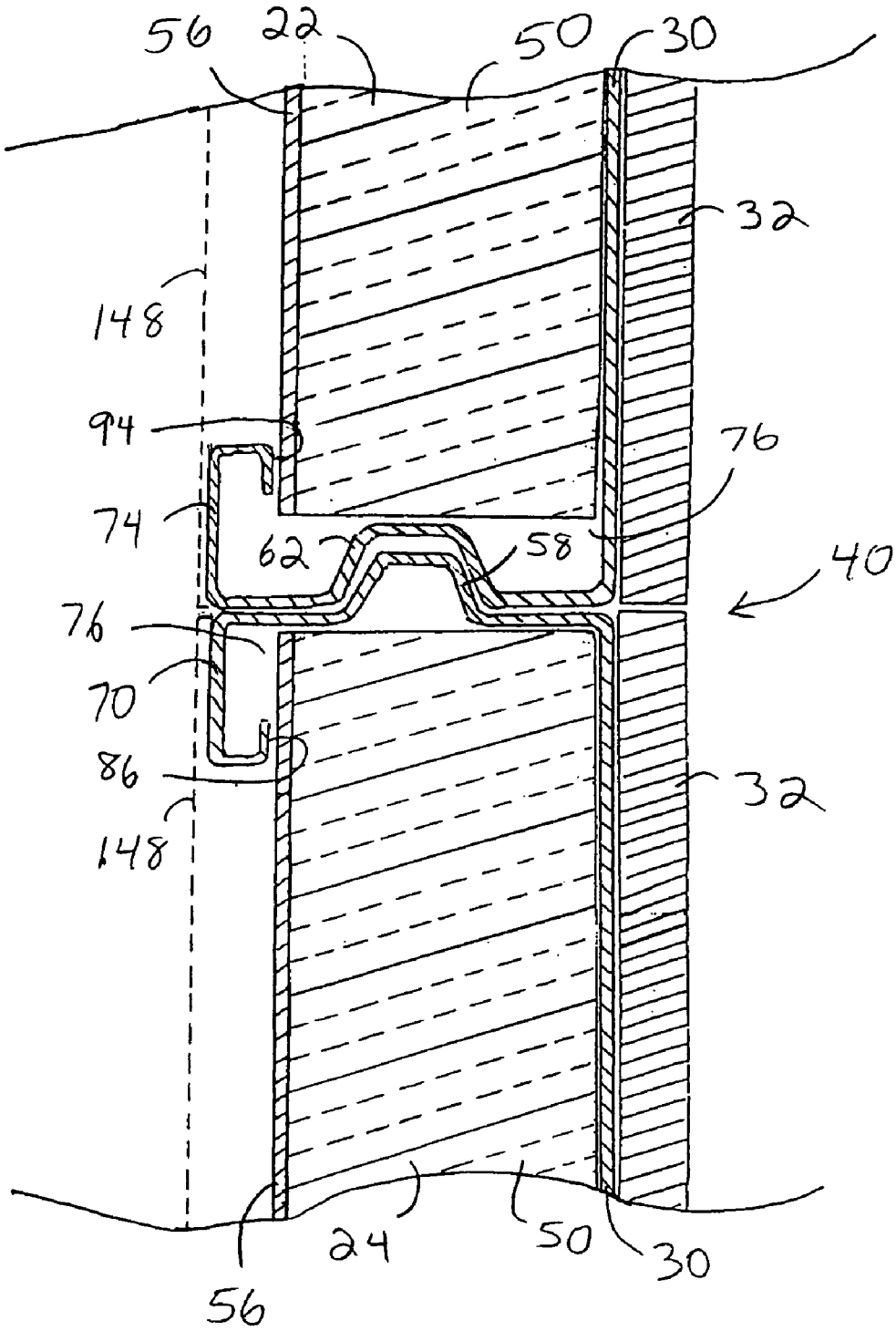
FIG. 7 shows a partial side view of a section joint between two door sections of the carriage house replica garage door of FIG. 1.

FIG. 7 shows a partial side view of one of section joints 40 between two door sections of the carriage house replica garage door 20 (FIG. 1). For example, section joint 40 is formed between first door section 22 and second door section 24. As shown, tongue portion 58 of second door section 24 mates with groove portion 62 of first door section 22. Although not shown, groove portion 62 of second door section 24 mates with tongue portion 58 of third door section 26 in the same manner. Cellular foam trim boards 32 are installed on the outer face of first and second door sections 22 and 24, respectively.

FIG. 7 also shows foam insulating layer 50 with steel laminate backing 56 positioned in cavity 76. Second planar side 94 of second rear support section 74 abuts steel laminate backing 56 located in first door section 22. Likewise, first planar side 86 of first rear support section 70 abuts steel laminate backing 56 located in second door section 24. Dashed lines 148 represent the relationship between the location of end support members 106 (FIG. 4) and center support members 112 (FIG. 4) relative to first rear support section 70 of sheet metal layer 30 of second door section 24. Similarly, dashed lines 148 represent the relationship between the location of end support members 106 and center support members 112 relative to second rear support section 74 of sheet metal layer 30 of first door section 22.

Figure 8:
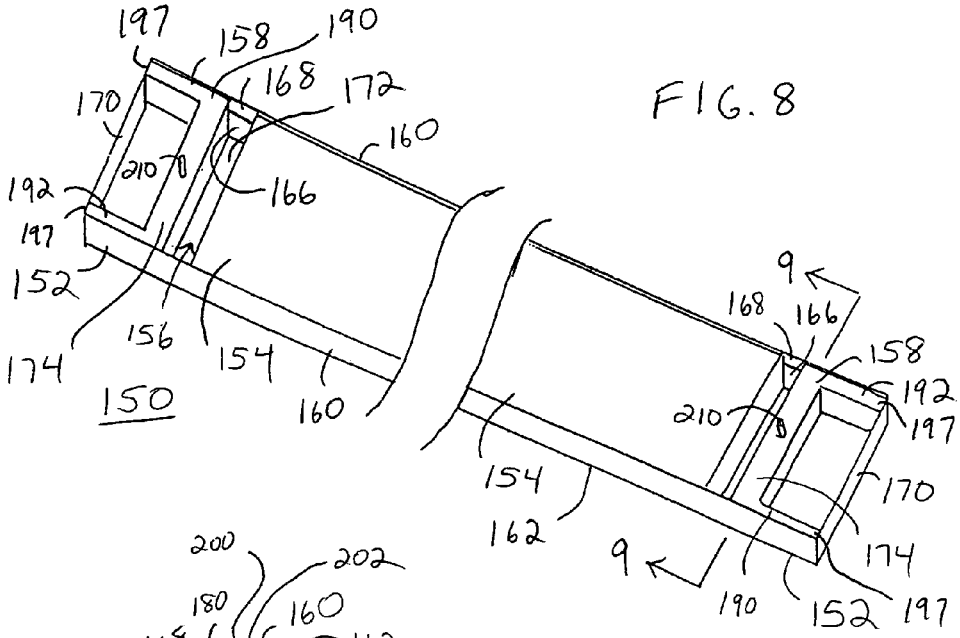
FIG. 8 shows a partial perspective view of a trim board system in accordance with an alternative embodiment of the present invention.
Figure 9:
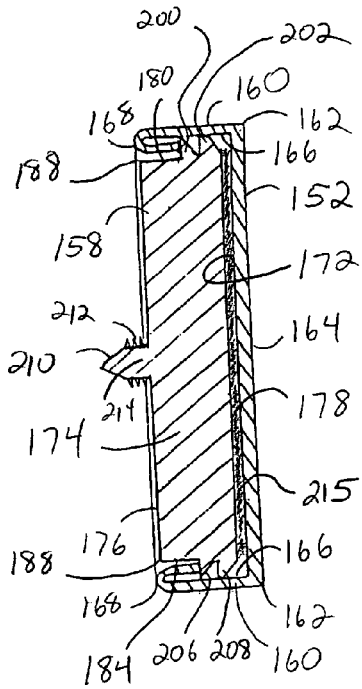
FIG. 9 shows a side sectional view of the trim board system along line 9-9 of FIG. 8.

Referring to FIGS. 8-9, FIG. 8 shows a partial perspective view of a trim board system 150 in accordance with an alternative embodiment of the present invention. FIG. 9 shows a side sectional view of trim board system 150 along line 9-9 of FIG. 8. Temperature extremes, direct sunlight, and color can have an undesirable impact on the ability of a material to be used as a trim board for carriage house replica door 20. For example, steel doors painted a dark color can reach temperatures in excess of two hundred degrees when the door is in direct sunlight and when the air temperature exceeds one hundred degrees. Under these extreme conditions, some materials may have expansion and contraction problems, such as buckling, cupping, splitting, bowing, and so forth, that render the materials unusable.

Accordingly, it will become apparent in the ensuing discussion that trim board system 150 can be advantageously utilized on the twenty-eight inch door sections 22, 24, and 26 (FIG. 1) of carriage house replica door 20 in lieu of, or as an adjunct to cellular foam trim boards 32 (FIG. 1) in locations subject to temperature extremes, direct sunlight, and/or when carriage house replica door is to be a dark color. In addition, although trim board system 150 is described in connection with carriage house replica door 20, described in detail above, trim board system 150 may be alternatively utilized in connection with steel or aluminum garage doors having an opened faced structure, other sandwich-style structures and more or less than the three twenty-eight inch door sections, described above.

Trim board system 150 includes a channel member 152, an insulating foam board 154 seated in an interior cavity 156 of channel member 152, and clips 158 positioned in interior cavity 156. Channel member 152 has substantially parallel legs 160 formed along longitudinal edges 162 of a face 164 of channel member 152. An interior surface 166 of each of legs 160 includes a longitudinally oriented hem portion 168. In addition, channel member 152 includes closed ends 170 at opposing ends of face 164 of channel member 152. In a preferred embodiment, channel member 152 is manufactured from steel sheet metal by roll forming or bending the steel sheet metal.

Channel member 152 is oriented on one of door sections 22, 24, and 26 (FIG. 1) such that hem portion 168 abuts the one of door sections 22, 24, and 26. Hem portion 168 provides strength and rigidity to channel member 152, which enables trim board system to be laid flat on the door section. In addition, the configuration of hem portion 168 enables engagement of clips 158 to hem portion 166, discussed below.

Insulating foam board 154 is desirably adhered to an interior side 172 of channel member 152. In an exemplary embodiment, insulating foam board 154, may be expanded polystyrene foam (EPS) with a density of 0.7 or greater. However, those skilled in the art will recognize that other insulating materials may be employed as a substitute for EPS. Insulating foam board 154 functions to make the board more resistant to denting and/or crushing, acts as an insulator to reduce noise, and helps maintain the position of clips 158.

Figure 10:
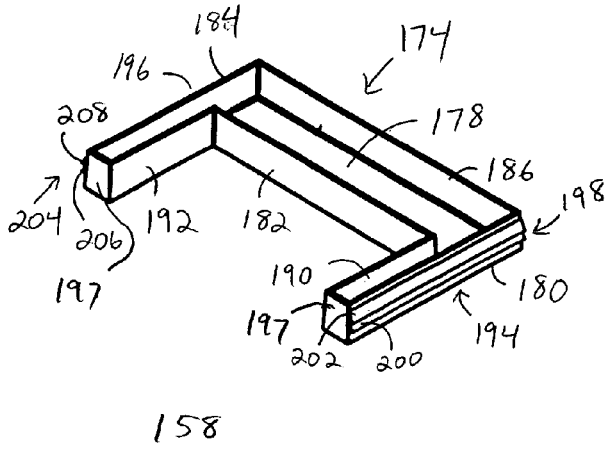
FIG. 10 shows a bottom perspective view of one of a clip of the trim board system of FIG. 8.
Figure 11:
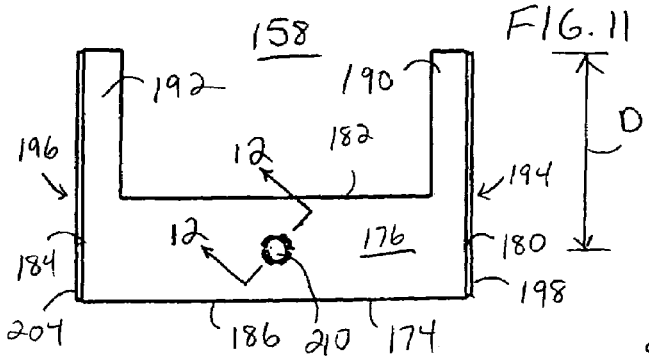
FIG. 11 shows a top view of one of the clip of FIG. 10.

Referring to FIGS. 10-11 in connection with FIGS. 8-9, FIG. 10 shows a bottom perspective view of one of clips 158 of trim board system 150, and FIG. 11 shows a top view of one of clips 158. Clips 158 are employed to attach channel member 152 to one of door sections 22, 24, and 26 (FIG. 1). Clips 158 may be manufactured from a thermoplastic material having a working temperature of at least two hundred and fifty degrees. Alternatively, clips 158 may be fabricated from nylon, steel, acrylonitrile-butadiene-styrene (ABS), or other rigid, corrosion resistant, workable materials. As particularly illustrated in FIG. 10, each clip 158 has an optional hollow interior for weight and cost reduction.

Each clip 158 includes a body 174 having an outer surface region 176 and an inner region 178. A first side wall 180, a second side wall 182, a third side wall 184, and a fourth side wall 186 define a perimeter and a width of body 174. As shown, first and third side walls 180 and 184, respectively, are located at opposing edges 188 of surface region 176, with second and fourth side walls 182 and 186 extending between first and third side walls 180 and 184.

Clip 158 further includes a first arm 190 and a second arm 192 extending from second side wall 182. In a preferred embodiment, first arm 190 extends perpendicular to second side wall 182 and is located proximate a first intersection edge 194 between first and second side walls 180 and 182, respectively. Similarly, second arm 192 extends perpendicular to second side wall 182 and is located proximate a second intersection edge 196 between second and third side walls 182 and 184, respectively. The presence of first and second arms 190 and 192 ensure efficient and proper positioning of clip 158 relative to closed ends 170 of channel member 152. That is, clip 158 can be rapidly installed in interior cavity 156 with an end 197 of each of first and second arms 190 and 192, respectively, abutting closed ends 170 of channel member 152. The significance of proper positioning of clips 158 will be further discussed in connection with the attachment of trim board assembly 150 to door sections 22, 24, and 26 shown in FIG. 13.

A first catch 198, in the form of first and second rib elements 200 and 202, respectively, are longitudinally aligned with and protrude from first side wall 180 and first arm 190. Second rib element 202 is also substantially parallel to first rib element 200. Likewise, a second catch 204, in the form of third and fourth rib elements 206 and 208, respectively, are longitudinally aligned with and protrude from third side wall 184 and second arm 192. Fourth rib element 208 is also substantially parallel to third rib element 206.

First and second catches 198 and 204, respectively, are configured to interlock with hem portions 68 of parallel legs 160. This interlocking mechanism causes clip 158 to be retained securely in interior cavity of channel member 152. The paired rib elements serve as a back up to one another. Accordingly, if one of the pair of rib elements does not interlock with hem portion 68, the other one of the pair will.

A preferred embodiment of the present invention utilizes the paired rib elements i.e. first and second rib elements 200 and 202 and third and fourth rib elements 206 and 208. However, those skilled in the art will recognize that each of first and second catches 198 and 204 may alternatively include only a single rib element. In addition, the rib elements of the present invention have a saw tooth configuration. However, those skilled in the art will also recognize that first and second catches 198 and 204 may take on different forms, with the object being to interlock clip 158 with parallel legs 160 of channel member 152.

Figure 12:
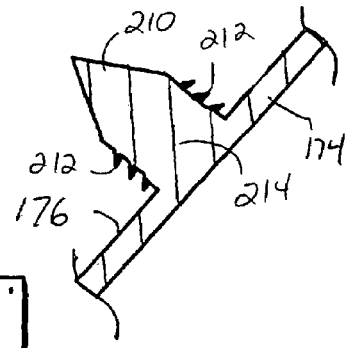
FIG. 12 shows a partial perspective view of a portion of the clip along line 12-12 of FIG. 11.

Referring to FIG. 12, FIG. 12 shows a partial perspective view of a portion of clip 158 along line 12-12 of FIG. 11. Clip 158 further includes a post 210 extending from outer surface region 176 of body 174. Post 210 includes flanges 212 laterally extending from an outer surface of a base 214 of post 210. Post 210 provides a fixation point for trim board system 150 to one of overhead sections 22, 24, and 26 (FIG. 1).

Referring momentarily to FIGS. 8-9, the manufacture of trim board system 150 entails the formation of channel member 152 via conventional roll forming methodology. An adhesive 215 may be coated over interior side 172 of channel member 152. Next, clips 158 and insulating foam board 154 can be installed into interior cavity 156 of channel member 152. Regarding clips 158, first and second catches 198 and 204, respectively, are engaged with hem portion 168 of each of parallel legs 160. The configuration of first and second catches 198 and 204 allow them to slide along hem portion 168 until ends 197 of each of first and second arms 190 and 192, respectively, abut closed ends 170 of channel member 152. Insulating foam board 154 is subsequently adhered to interior side 172 between pairs of clips 158. The combined use of adhesive 215 securing inner region 178 of clip 158 to channel member 152, the interlocking of first and second catches 198 and 204 with hem portion 168 of channel member 152, and the positioning of insulating foam board 154 between clips 158 functions to retain clips 158 securely so that posts 210 are in the appropriate location for attachment to a door section.

Figure 13:
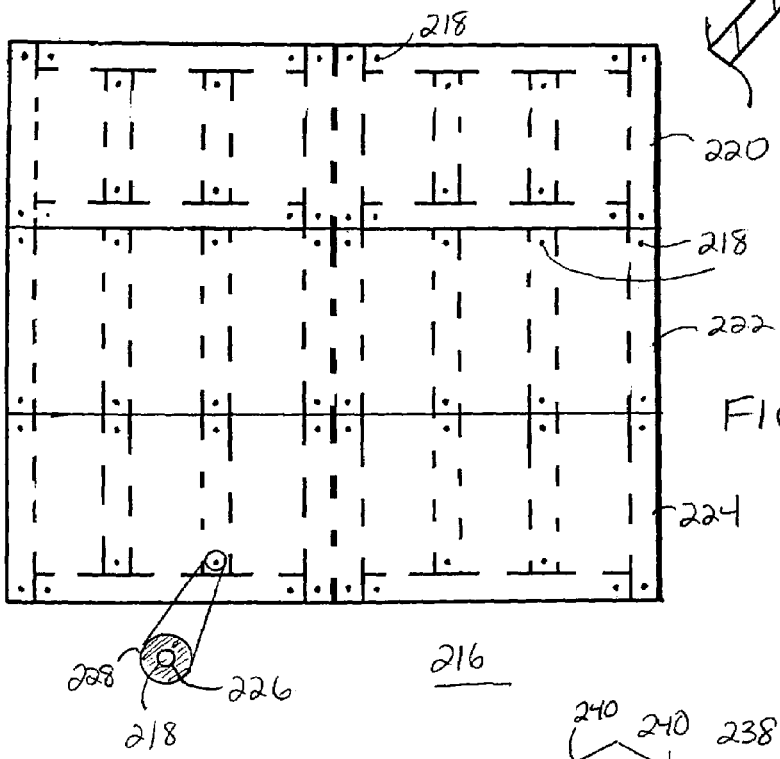
FIG. 13 shows a front view of a carriage house replica garage door to which the trim board system of FIG. 8 has not yet been attached.

Referring to FIG. 13 in connection with FIG. 12, FIG. 13 shows a front view of a carriage house replica garage door 216 to which trim board system 150 (FIG. 8) has not yet been attached. As such, a pattern of bores 218, or holes, can be visualized on each of a first, second, and third door section 220, 222, and 224, respectively, of door 216. Each of bores 218 is defined by a perimeter edge 226, as shown in an enlarged partial view 228 of door 216. Post 210 is sized to fit within bore 218. When post 210 is pushed into bore 218, flanges 212 interlock with perimeter edge 226 so that trim board system 150 is securely attached to one of door sections 220, 222, and 224.

The manufacture of door 216 entails the formation of each of door sections 220, 222, and 224 by first feeding steel for a face 230 of the door section from an uncoiler into a texture or embossing machine, if a textured door section is desired. Bores 218 are subsequently punched through face 230 of the door section skin, and a desired tongue and groove rail is fashioned by roll forming. The utilization of first and second arms 190 and 192 (FIG. 9) permits clips 158 (FIG. 9) to stand off from closed ends 170 (FIG. 9) of channel members (FIG. 9). In a preferred embodiment, this stand off dimension, D (see FIG. 11), is approximately two inches for trim board systems that are four inches in width. As such, bore punching into door sections 220, 222, and 224 for either of the vertically and the horizontally positioned trim board systems 150 are in the same line. This permits the use of the same punch for all of bores 218 in door sections 220, 222, and 224, thus saving manufacturing time and its associated cost.

Following installation of insulating foam board 50 (FIG. 2) into the cavity of the door section and optional placement of a steel buckskin on the back of the door section, trim board systems 150 are applied to face 230. Overhead projectors may project the desired pattern for location of trim board systems 150 onto door sections 220, 222, and 224. Trim board systems 150 are then secured onto face 230 by pushing posts 210 into mating bores 218. Once applied, the assemblers may apply caulking around the perimeter of trim board system 150 to prevent vibration noise from trim board system 150, to provide additional adhesion, and to prevent moisture from entering the underside of trim board system 150. Since posts 210 provide the primary means for attachment of trim board system 150 to face 232, should the trim board system become damaged, it can readily be unclipped from the face of the door and repaired or replaced.

Figure 14:
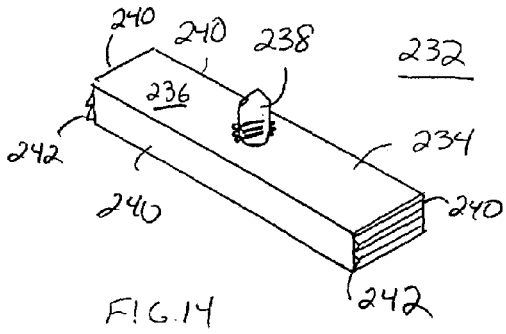
FIG. 14 shows a clip for use with the trim board system of FIG. 8 in accordance with an alternative embodiment of the present invention.

FIG. 14 shows a clip 232 for use with the trim board system of FIG. 8 in accordance with an alternative embodiment of the present invention. Clip 232 is similar to clip 158 (FIG. 9) with the exception being that clip 232 does not include first and second arms 190 and 192 (FIG. 9), respectively. Accordingly, clip 232 includes a body 234 having a surface region 236 from which a post 238 extends and having side walls 240. A pair of opposing side walls 240 includes catches 242, such as those taught in connection with clip 158. Thus, catches 242 interlock with hem portions 168 of parallel legs 160 of channel member 152.

In some designs for the carriage house replica door, it is envisioned that a trim board system 150 may mate to the middle of a non-parallel trim board system 150. In such a situation bores 218 may not be in line with one another. Thus, clip 232 can be placed more readily where it is needed.

Accordingly, a strong steel trim board is formed that replicates the appearance of wood but is but is impervious to the problems encountered with temperature extremes, direct sunlight, and dark colors. Insulating foam board 154 located in the interior of channel member 152 is lightweight, while at the same time, fills interior cavity 156 between to help reduce the denting or crushing that might occur due to compressive force. Clip 158, and alternatively clip 232, provides a simple, inexpensive mechanism for secure attachment of the steel trim board to the door sections.

In summary, the present invention teaches of a door section for a carriage house replica garage door. The carriage house replica garage door, fabricated from three door sections and trimmed with wood grain pattern trim boards, forms an aesthetically pleasing and cost effective replica of a wood sectional carriage house garage door. The trim board system disclosed herein is durable, not subject to degradation by weather, is lightweight, and is cost effective to manufacture. As such, the carriage house replica garage door, having the steel trim board systems including the clip attachment mechanism requires little maintenance. However, should the trim board system become damaged, it can readily be unclipped from the face of the door and repaired or replaced.

Although the preferred embodiments of the invention have been illustrated and described in detail, it will be readily apparent to those skilled in the art that various modifications may be made therein without departing from the spirit of the invention or from the scope of the appended claims. For example, the door sections may be adapted for use in a four section carriage house replica garage door, rather than the three section carriage house garage door described herein.

What is claimed is:

1. An apparatus, comprising:

a garage door panel; and a trim board that is clipped to said garage door panel through the use of a clip, wherein said trim board includes an insulating foam board and a channel member having a face, an interior cavity, and substantially parallel legs, wherein said substantially parallel legs are formed along longitudinal edges of said face, and wherein said insulating foam board is seated in said interior cavity, said clip comprising:

a body positioned in said interior cavity of said channel member, said body having a surface region and side walls along edges of said surface region, wherein said surface region is an outer surface region, said body further including an inner region, said channel member further including an interior side, and wherein said inner region is coupled to said interior side using an adhesive;

a catch formed on one of said side walls and interlocked with one of said substantially parallel legs of said channel section; and a post extending from said surface region, said post being configured to fit within a bore in said door section to retain said trim board onto said door section.

2. The apparatus as recited in claim 1, wherein said clip further comprises an arm extending from a second one of said side walls, said second one of side walls being arranged substantially perpendicular to said first one of said side walls, and wherein said arm includes a distal end, said channel member including a closed end, wherein said distal end abuts said closed end.

3. An apparatus, comprising:

a garage door panel having a bore;

a trim board having a face; and a clip for attaching said trim board to said garage door panel, wherein said trim board has substantially parallel legs formed along longitudinal edges of said face of said trim board, and said clip comprising:

a body having a surface region, a first side wall, a second side wall, and a third side wall, said first and third side walls being located along opposing edges of said surface region, and said second side wall extending between said first and third side walls, wherein said second wall is substantially perpendicular to said first and third side walls, and wherein said second wall extends from one of said substantially parallel legs of said trim board to the other of said substantially parallel legs;

a post extending from said surface region, said post being configured to fit within said bore to retain said trim board onto said garage door panel.

4. The apparatus as recited in claim 3, wherein said bore includes a perimeter edge, and wherein said post includes flange elements laterally extending from said post, said flange elements being configured to interconnect with said perimeter edge.

5. The apparatus as recited in claim 3, wherein said first and second side walls include a first intersection edge that is between said first and second side walls, and wherein said clip includes an arm extending from said second side wall proximate said first intersection edge, said clip further including a catch formed along each of said first side wall and said arm, said catch being configured to interlock with one of said substantially parallel legs of said trim board.

6. The apparatus as recited in claim 5, wherein said arm is a first arm, wherein said second and third side walls include a second intersection edge between said second and third side walls, and wherein said catch is a first catch, said clip further comprises:

a second arm extending from said second side wall proximate said second intersection edge; and a second catch formed along each of said third side wall and said second arm, said second catch being configured to interlock with the other of said substantially parallel legs of said trim board.

7. The apparatus as recited in claim 5, wherein an interior surface of said one of said substantially parallel legs includes a longitudinally oriented hem portion, and said catch protrudes from each of said first side wall and said arm to interlock with said hem portion.

8. The apparatus as recited in claim 7, wherein said catch comprises a rib element longitudinally aligned with and extending from each of said first side wall and said arm.

9. An apparatus, comprising:

a garage door panel having a bore;

a trim board having a face; and a clip for attaching said trim board to said garage door panel, wherein said trim board has legs formed along longitudinal edges of said face of said trim board, and said clip comprising:

a body having a surface region, a first side wall, a second side wall, and a third side wall, said first and third side walls being located along opposing edges of said surface region, and said second side wall extending between said first and third side walls, wherein said second wall is substantially perpendicular to said first and third side walls, and wherein said second wall extends from one of said legs of said trim board to the other of said legs;

a post extending from said surface region, said post being configured to fit within said bore to retain said trim board onto said garage door panel.

* * * * *